US012673836B2

(12) United States Patent
Baba

(10) Patent No.: US 12,673,836 B2
(45) Date of Patent: Jul. 7, 2026

(54) SHEET PROCESSING APPARATUS CAPABLE OF SAVING TROUBLE OF USER AND PROCESSING CONDITION SETTING METHOD

(71) Applicant: KYOCERA Document Solutions Inc., Osaka (JP)

(72) Inventor: Masaki Baba, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 486 days.

(21) Appl. No.: 18/334,891

(22) Filed: Jun. 14, 2023

(65) Prior Publication Data

US 2023/0406661 A1 Dec. 21, 2023

(30) Foreign Application Priority Data

Jun. 15, 2022 (JP) ..... 2022-096252

(51) Int. Cl.
*B65H 7/20* (2006.01)
*B65H 7/02* (2006.01)

(52) U.S. Cl.
CPC ..... *B65H 7/20* (2013.01); *B65H 7/02* (2013.01); *B65H 2511/10* (2013.01)

(58) Field of Classification Search
CPC ..... B65H 7/02; B65H 7/20; B65H 2511/10; B41J 29/38
See application file for complete search history.

(56) References Cited

U.S. PATENT DOCUMENTS

2014/0268234 A1 9/2014 Iida et al.
2017/0308019 A1* 10/2017 Nishino ..... G03G 15/5062

FOREIGN PATENT DOCUMENTS

JP 2014205343 A 10/2014

* cited by examiner

*Primary Examiner* — Thomas A Morrison
(74) *Attorney, Agent, or Firm* — Alleman Hall LLP

(57) ABSTRACT

A sheet processing apparatus includes a display processing portion, a setting processing portion, an acceptance processing portion, and a change processing portion. The display processing portion causes a setting screen including a detection result on a sheet size of a sheet stored in a sheet storing portion to be displayed. The setting processing portion sets a processing condition of the sheet based on information included in the setting screen. The acceptance processing portion causes some of sheet sizes used for setting the processing condition to be displayed according to a specific operation corresponding to the detection result on the sheet size of the sheet included in the setting screen, and accepts a designation operation for designating any of the displayed sheet sizes. The change processing portion changes, according to the designation operation, the sheet size included in the setting screen to a sheet size designated by the designation operation.

3 Claims, 7 Drawing Sheets

SHEET PROCESSING APPARATUS CAPABLE OF SAVING TROUBLE OF USER AND PROCESSING CONDITION SETTING METHOD

INCORPORATION BY REFERENCE

This application is based upon and claims the benefit of priority from the corresponding Japanese Patent Application No. 2022-096252 filed on Jun. 15, 2022, the entire contents of which are incorporated herein by reference.

BACKGROUND

The present disclosure relates to a sheet processing apparatus and a processing condition setting method executed in the sheet processing apparatus.

In an image forming apparatus that uses electrophotography, a processing condition of a sheet onto which a toner image is to be transferred, such as a fixing temperature of a fixing member which heats the sheet, is set based on sheet information such as a paper catalogue related to the sheet.

Further, an image forming apparatus which sets the processing condition based on the sheet information and a detection result obtained by a detection portion which detects a sheet size of a sheet stored in a sheet feed cassette is known as a related art. Specifically, in this image forming apparatus, when the sheet information designated by a user includes specific information, a setting screen including the detection result obtained by the detection portion and other pieces of information included in the sheet information is displayed.

SUMMARY

A sheet processing apparatus according to an aspect of the present disclosure includes a sheet storing portion, a detection processing portion, a first acceptance processing portion, a display processing portion, a setting processing portion, a second acceptance processing portion, and a change processing portion. The sheet storing portion stores a sheet. The detection processing portion detects a sheet size of a stored sheet stored in the sheet storing portion. The first acceptance processing portion accepts a first designation operation for designating sheet information including first attribute information related to a sheet size and second attribute information related to a sheet attribute different from the sheet size. The display processing portion causes a setting screen to be displayed when the first attribute information included in the sheet information designated by the first designation operation is predetermined specific attribute information, the setting screen including a detection result obtained by the detection processing portion and the second attribute information included in the sheet information. The setting processing portion sets a processing condition of the stored sheet based on information included in the setting screen. The second acceptance processing portion causes some of sheet sizes used for setting the processing condition to be displayed according to a specific operation corresponding to the detection result obtained by the detection processing portion, that is included in the setting screen, and accepts a second designation operation for designating any of the displayed sheet sizes. The change processing portion changes, according to the second designation operation, the sheet size included in the setting screen from the detection result obtained by the detection processing portion to a sheet size designated by the second designation operation.

A processing condition setting method according to another aspect of the present disclosure is executed in a sheet processing apparatus including a sheet storing portion which stores a sheet, and includes a detection step, a first acceptance step, a display step, a setting step, a second acceptance step, and a change step. The detection step includes detecting a sheet size of a stored sheet stored in the sheet storing portion. The first acceptance step includes accepting a first designation operation for designating sheet information including first attribute information related to a sheet size and second attribute information related to a sheet attribute different from the sheet size. The display step includes causing a setting screen to be displayed when the first attribute information included in the sheet information designated by the first designation operation is predetermined specific attribute information, the setting screen including a detection result obtained in the detection step and the second attribute information included in the sheet information. The setting step includes setting a processing condition of the stored sheet based on information included in the setting screen. The second acceptance step includes causing some of sheet sizes used for setting the processing condition to be displayed according to a specific operation corresponding to the detection result obtained in the detection step, that is included in the setting screen, and accepting a second designation operation for designating any of the displayed sheet sizes. The change step includes changing, according to the second designation operation, the sheet size included in the setting screen from the detection result obtained in the detection step to a sheet size designated by the second designation operation.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the attached drawings. It is noted that the following embodiment is an embodied example of the present disclosure and does not limit the technical scope of the present disclosure.

[Configuration of Image Forming Apparatus 100]

Figure 1:
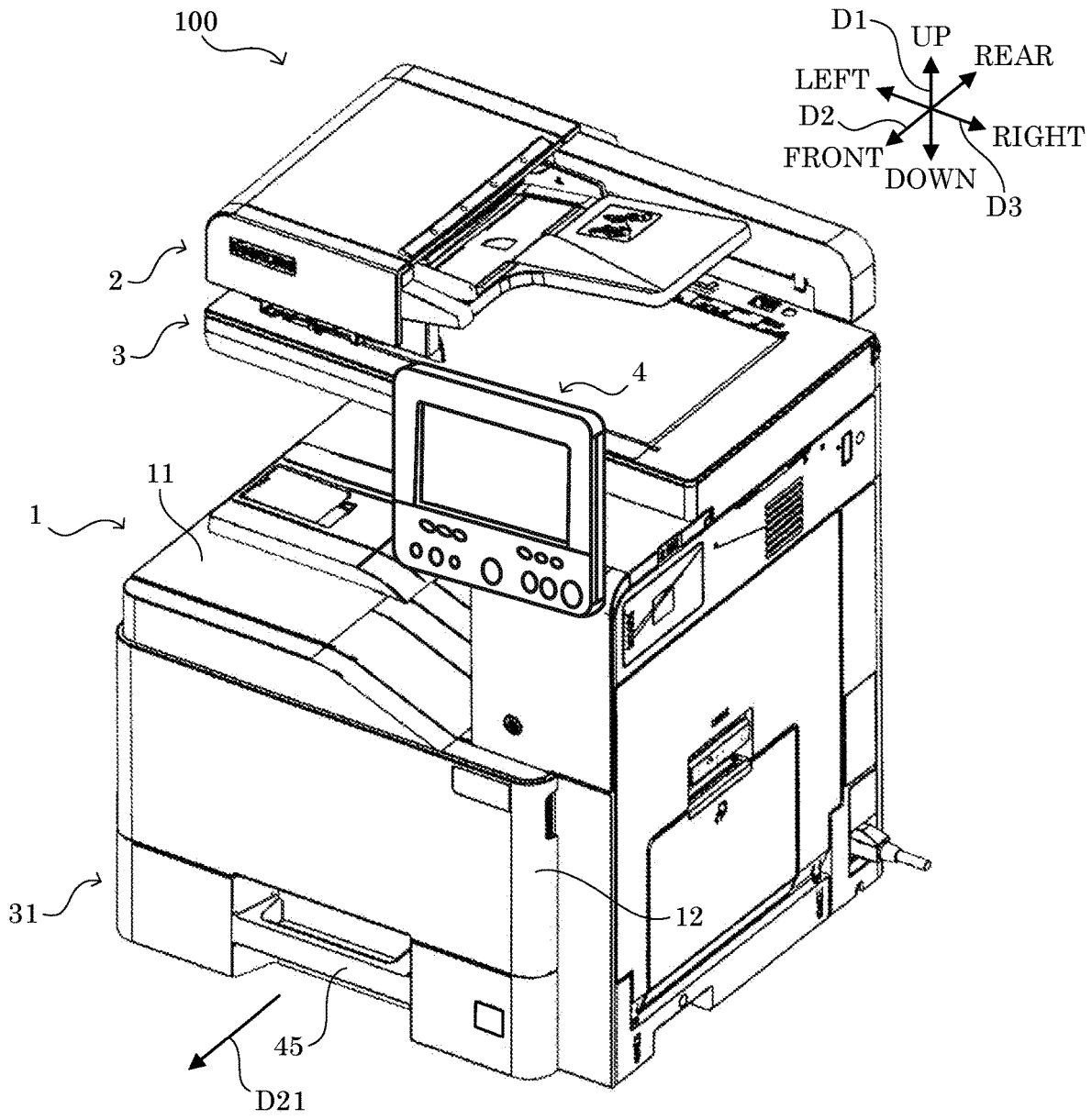
FIG. 1 is a diagram showing a configuration of an image forming apparatus according to an embodiment of the present disclosure.
Figure 2:
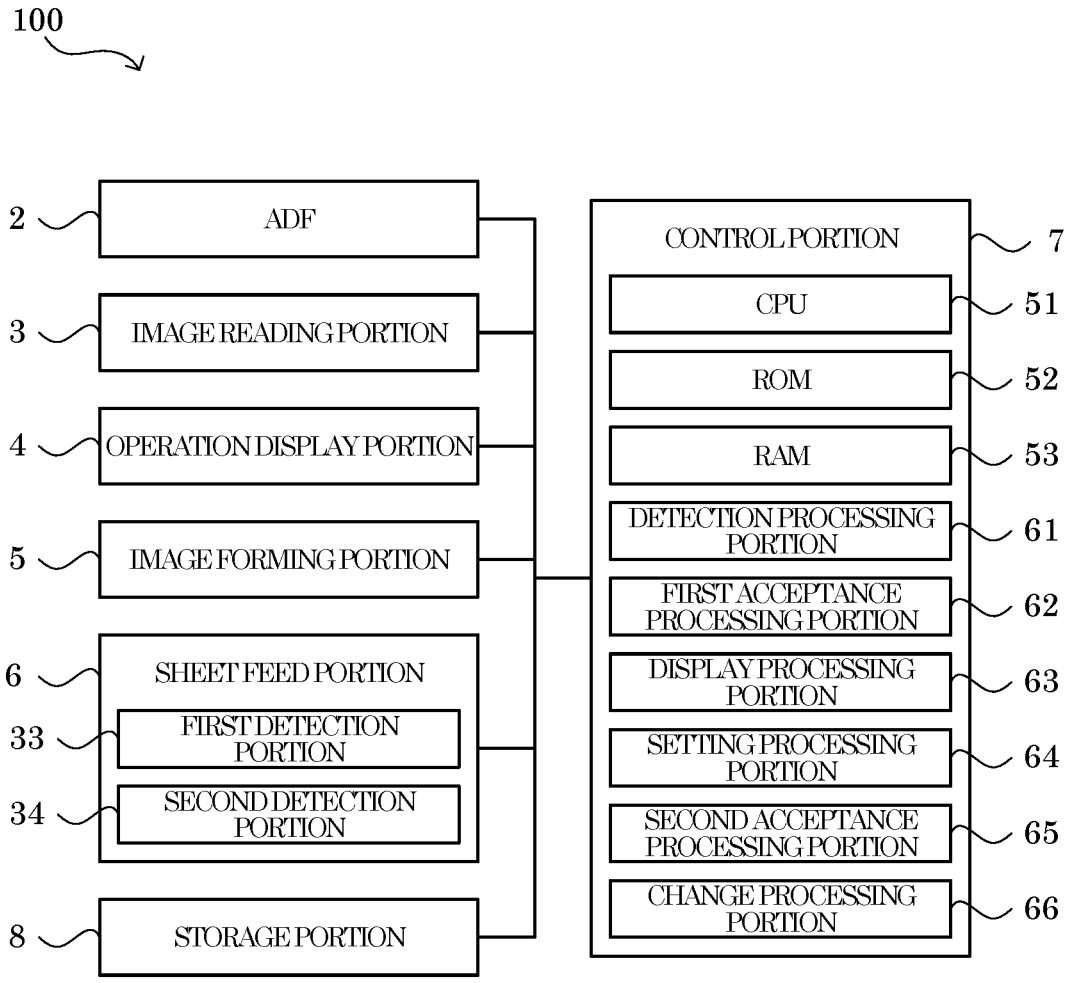
FIG. 2 is a diagram showing a system configuration of the image forming apparatus according to the embodiment of the present disclosure.
Figure 3:
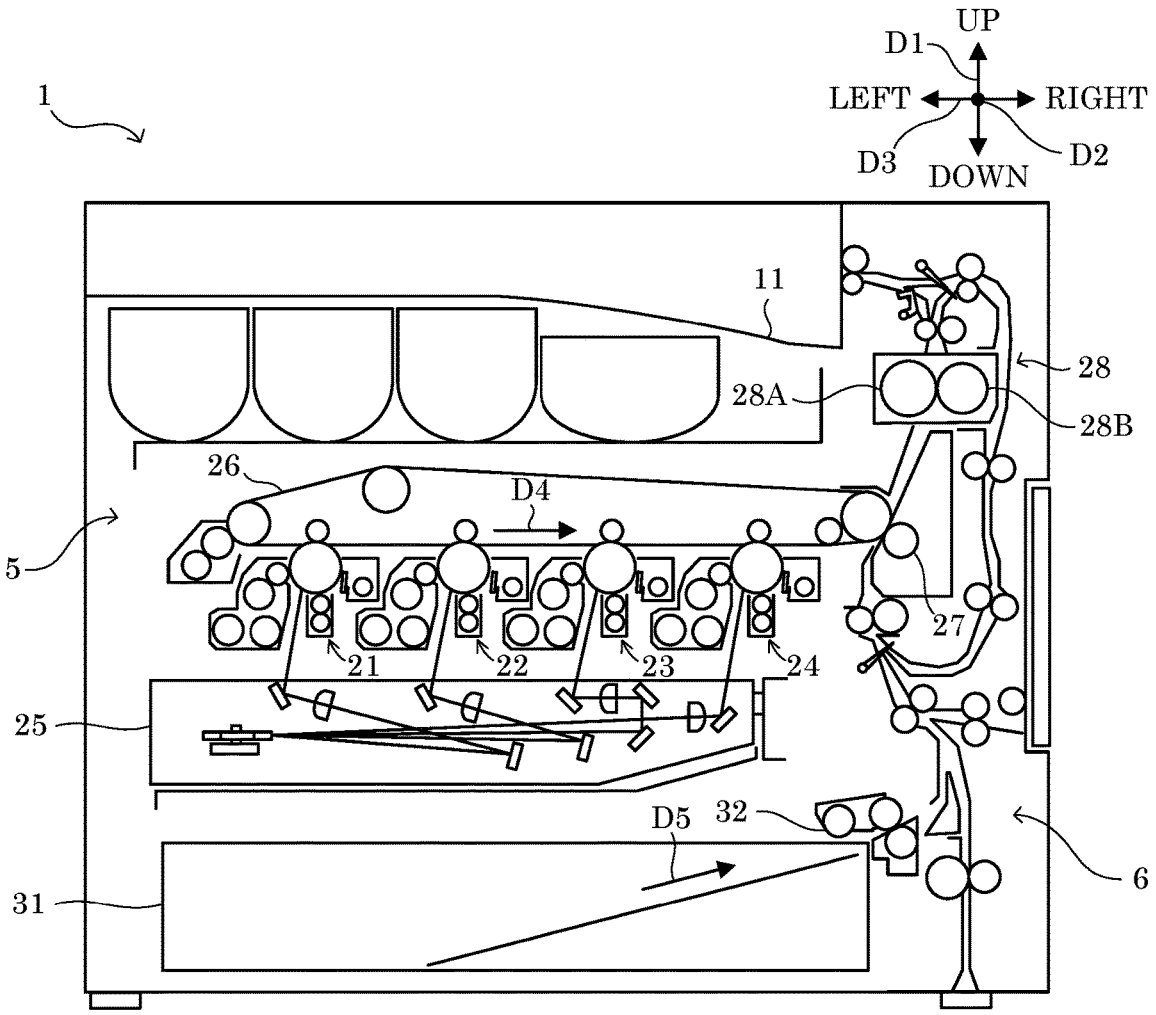
FIG. 3 is a diagram showing an internal configuration of a housing of the image forming apparatus according to the embodiment of the present disclosure
Figure 4:
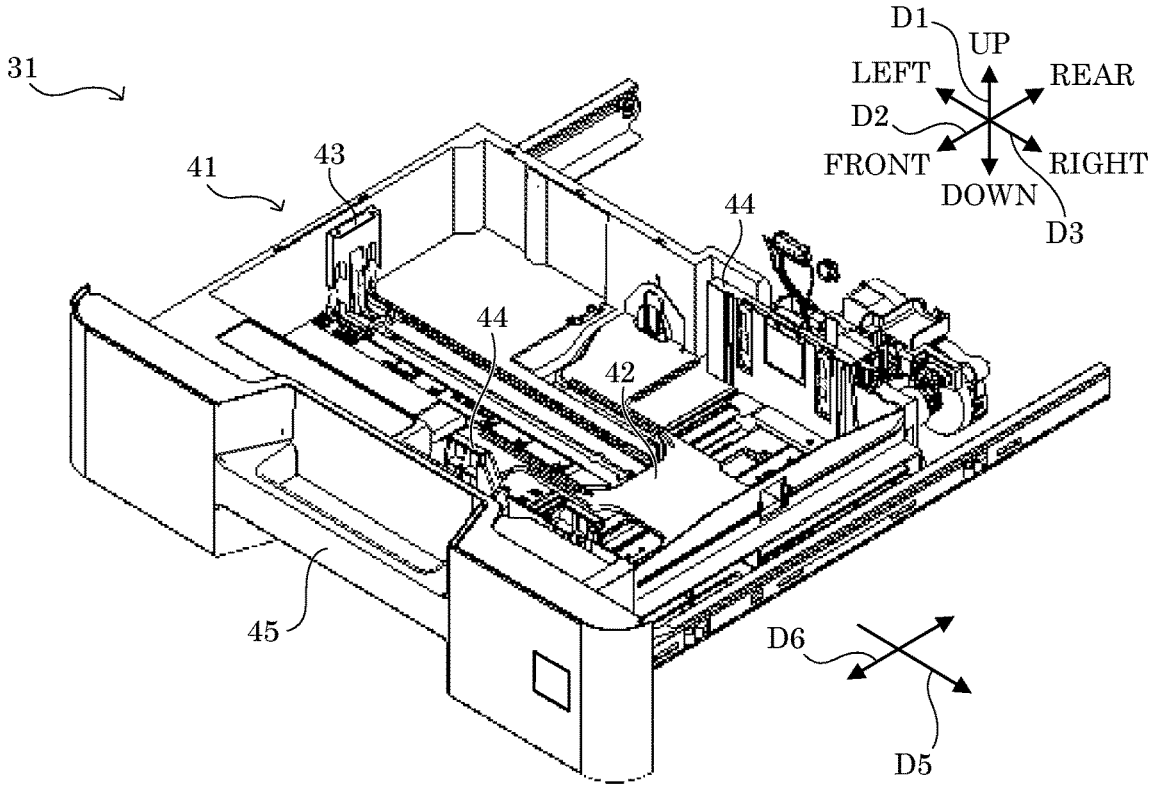
FIG. 4 is a diagram showing a configuration of a sheet feed cassette of the image forming apparatus according to the embodiment of the present disclosure.

First, with reference to FIG. 1 to FIG. 5, a configuration of an image forming apparatus 100 according to the embodiment of the present disclosure will be described. Herein, FIG. 1 is a perspective view showing an outer appearance of the image forming apparatus 100. Further, FIG. 2 is a block diagram showing a system configuration of the image forming apparatus 100. In addition, FIG. 3 is a cross-sectional diagram showing an internal configuration of a housing 1. Furthermore, FIG. 4 is a perspective view showing a configuration of a sheet feed cassette 31.

It is noted that for convenience of descriptions, a vertical direction in a state where the image forming apparatus 100 is installed in a usable state (state shown in FIG. 1) is defined as an up-down direction D1. In addition, a front-rear direction D2 is defined with a surface of the image forming apparatus 100 on a front left side of the diagram shown in FIG. 1 being a front surface (front side). In addition, a left-right direction D3 is defined using the front surface of the image forming apparatus 100 in the installed state as a reference.

The image forming apparatus 100 is a multifunction peripheral that includes a plurality of functions such as a facsimile function and a copying function together with a scanning function for reading an image on a document sheet and a printing function for forming an image on a sheet based on image data. The image forming apparatus 100 is an example of a sheet processing apparatus of the present disclosure. It is noted that the present disclosure may also be applied to an image forming apparatus such as a printer, a facsimile apparatus, and a copying machine. Moreover, the present disclosure may also be applied to a sheet processing apparatus which executes processing different from image forming processing, like cutting processing, for example, on a sheet.

As shown in FIG. 1 to FIG. 3, the image forming apparatus 100 includes the housing 1, an ADF 2, an image reading portion 3, an operation display portion 4, an image forming portion 5, a sheet feed portion 6, a control portion 7, and a storage portion 8.

As shown in FIG. 3, the housing 1 houses the image forming portion 5 and the sheet feed portion 6. The housing 1 is formed substantially in a rectangular parallelepiped shape. As shown in FIG. 1, the ADF 2 and the image reading portion 3 are provided above the housing 1. In addition, the operation display portion 4 is provided on a front side of the housing 1.

As shown in FIG. 1 and FIG. 3, a sheet reception portion 11 is provided at an upper portion of the housing 1. A sheet on which an image has been formed by the image forming portion 5 is discharged to the sheet reception portion 11. Further, as shown in FIG. 1, a front cover 12 is provided at a front portion of the housing 1. The front cover 12 forms a part of the front surface of the housing 1. Furthermore, an opening portion is provided below the front cover 12 in the housing 1. The sheet feed cassette 31 is inserted/drawn out into/from the opening portion.

The ADF 2 conveys a document sheet to be read by the image reading portion 3. Specifically, the ADF 2 includes a document sheet setting portion, a plurality of document sheet conveying rollers, a document sheet holder, and a document sheet discharge portion. The ADF 2 conveys a document sheet placed on the document sheet setting portion to the document sheet discharge portion via an image reading position of the image reading portion 3.

The image reading portion 3 realizes the scanning function. Specifically, the image reading portion 3 includes a document sheet table, a light source, a plurality of mirrors, an optical lens, and a CCD. The image reading portion 3 reads an image of a document sheet from the document sheet placed on the document sheet table or the document sheet conveyed by the ADF 2.

The operation display portion 4 is a user interface of the image forming apparatus 100. The operation display portion 4 includes a display portion such as a liquid crystal display that displays various types of information in response to control instructions from the control portion 7 and an operation portion such as operation keys or a touch panel for inputting various types of information to the control portion 7 in accordance with user operations.

The image forming portion 5 realizes the printing function. Specifically, the image forming portion 5 forms an image on a sheet supplied from the sheet feed portion 6 using electrophotography. It is noted that the present disclosure may also be applied to an image forming apparatus which forms an image on a sheet using an image forming system different from electrophotography, such as an ink-jet system, for example.

As shown in FIG. 3, the image forming portion 5 includes a plurality of image forming units 21 to 24 respectively corresponding to Y (yellow), M (magenta), C (cyan), and K (black), a laser scanning unit (LSU) 25, an intermediate transfer belt 26, a secondary transfer roller 27, and a fixing device 28.

The image forming units 21 to 24 are arranged along a belt rotation direction D4 (see FIG. 3) of the intermediate transfer belt 26. The image forming unit 21 forms a toner image corresponding to Y (yellow). The image forming unit 22 forms a toner image corresponding to M (magenta). The image forming unit 23 forms a toner image corresponding to C (cyan). The image forming unit 24 forms a toner image corresponding to K (black).

The image forming unit 21 includes a photoconductor drum and a charging device, a developing device, a primary transfer roller, and a cleaning device that are provided in correspondence with the photoconductor drum. The image forming units 22 to 24 also have configurations similar to that of the image forming unit 21.

The photoconductor drum carries a toner image. The charging device charges a surface of the photoconductor drum at a predetermined potential. Laser light based on image data, that is emitted from the laser scanning unit 25, is irradiated onto the surface of the photoconductor drum charged by the charging device. Thus, an electrostatic latent image that is based on the image data is formed on the surface of the photoconductor drum. The developing device uses developer including toner to develop the electrostatic latent image formed on the surface of the photoconductor drum. The primary transfer roller transfers the toner image developed by the developing device onto the intermediate transfer belt 26. The cleaning device cleans the surface of the photoconductor drum after the toner image is transferred by the primary transfer roller.

The intermediate transfer belt 26 travels above the photoconductor drum of each of the image forming units 21 to 24. Toner images of the respective colors that have been formed on the respective photoconductor drums are transferred onto the intermediate transfer belt 26 while overlapping one another.

The secondary transfer roller 27 transfers the toner images on the intermediate transfer belt 26 onto a sheet supplied from the sheet feed portion 6.

The fixing device 28 fixes the toner images that have been transferred onto the sheet by the secondary transfer roller 27 onto the sheet. As shown in FIG. 3, the fixing device 28 includes a fixing roller 28A and a pressure roller 28B. The fixing roller 28A is heated to a predetermined fixing temperature. The pressure roller 28B is biased toward the fixing roller 28A and forms a fixing nip portion with the fixing roller 28A. In the fixing device 28, the sheet that passes through the fixing nip portion is heated and pressurized by the fixing roller 28A and the pressure roller 28B. Thus, the toner images that have been transferred onto the sheet are fixed onto the sheet. The sheet onto which the toner images have been fixed by the fixing device 28 is discharged to the sheet reception portion 11.

The sheet feed portion 6 supplies sheets to the image forming portion 5. As shown in FIG. 3, the sheet feed portion 6 includes the sheet feed cassette 31, a pickup roller 32, and a plurality of sheet conveying rollers. Moreover, as shown in FIG. 2, the sheet feed portion 6 includes a first detection portion 33 and a second detection portion 34.

The sheet feed cassette 31 stores sheets to be supplied to the image forming portion 5. The sheet feed cassette 31 is an example of a sheet storing portion of the present disclosure. It is noted that in descriptions below, sheets stored in the sheet feed cassette 31 may be referred to as "stored sheets".

As shown in FIG. 4, the sheet feed cassette 31 includes a storing portion 41, a lifting member 42, a rear end cursor 43, a pair of side cursors 44, and a grip portion 45.

The storing portion 41 defines a sheet storing space. As shown in FIG. 4, the storing portion 41 is formed in a box shape that is opened upwardly.

The sheet feed cassette 31 can be drawn out from the opening portion of the housing 1 in a front direction D21 (see FIG. 1). Specifically, the sheet feed cassette 31 is supported while being slidable in the front-rear direction D2 inside the housing 1. For example, a pair of rails elongated in the front-rear direction D2 are provided inside the housing 1. Moreover, the storing portion 41 includes a pair of rail guides that engage with the pair of rails to enable the sheet feed cassette 31 to slide in the front-rear direction D2. Thus, the sheet feed cassette 31 can be drawn out in the front direction D21 from a state where the sheet feed cassette 31 is attached to the image forming apparatus 100. It is noted that a movement mechanism of the sheet feed cassette 31 may be a mechanism other than the rail supporting mechanism constituted by the pair of rails and the pair of rail guides.

The lifting member 42 is provided at a bottom portion of the storing portion 41 while being liftable in the up-down direction D1. The lifting member 42 lifts a stack of sheets stored in the sheet feed cassette 31 to a contact position at which the stack of sheets come into contact with the pickup roller 32.

The rear end cursor 43 is provided at the bottom portion of the storing portion 41 while being movable in the left-right direction D3. The rear end cursor 43 comes into contact with rear end portions of the stored sheets in a sheet conveying direction D5 (see FIG. 4) and adjusts positions of the stored sheets in the left-right direction D3.

The pair of side cursors 44 are provided at the bottom portion of the storing portion 41 while being movable in the front-rear direction D2. The pair of side cursors 44 come into contact with both end portions of the stored sheets in a sheet width direction D6 (see FIG. 4) and adjust positions of the stored sheets in the front-rear direction D2.

The grip portion 45 is provided at a front end portion of the sheet feed cassette 31. The grip portion 45 is used for inserting/drawing out the sheet feed cassette 31 into/from the housing 1.

The pickup roller 32 conveys, in the sheet conveying direction D5 (see FIG. 3 and FIG. 4), an uppermost sheet out of the stack of sheets lifted to the contact position by the lifting member 42. The sheet conveyed by the pickup roller 32 is conveyed to a toner image transfer position of the secondary transfer roller 27 by the plurality of sheet conveying rollers.

The first detection portion 33 detects a size of the stored sheets in the sheet conveying direction D5 (see FIG. 4). For example, the first detection portion 33 is an electric circuit which includes a first variable resistor whose electrical resistance varies depending on an arrangement position of the rear end cursor 43 in the storing portion 41 and is capable of outputting a first electric signal corresponding to the electrical resistance of the first variable resistor.

The second detection portion 34 detects a size of the stored sheets in the sheet width direction D6 (see FIG. 4). For example, the second detection portion 34 is an electric circuit which includes a second variable resistor whose electrical resistance varies depending on an interval between the pair of side cursors 44 and is capable of outputting a second electric signal corresponding to the electrical resistance of the second variable resistor.

The control portion 7 collectively controls the image forming apparatus 100. As shown in FIG. 2, the control portion 7 includes a CPU 51, a ROM 52, and a RAM 53. The CPU 51 is a processor which executes various types of calculation processing. The ROM 52 is a nonvolatile storage device in which information such as control programs for causing the CPU 51 to execute various types of processing is stored in advance. The RAM 53 is a volatile or nonvolatile storage device which is used as a temporary storage memory (working area) for the various types of processing executed by the CPU 51. The CPU 51 executes the various control programs stored in advance in the ROM 52. Thus, the image forming apparatus 100 is controlled collectively.

The storage portion 8 is a nonvolatile storage device. For example, the storage portion 8 is a storage device such as a nonvolatile memory such as a flash memory and an EEPROM, an SSD (Solid State Drive), and an HDD (Hard Disk Drive).

In the storage portion 8, a plurality of pieces of sheet information X100 (see FIG. 5) related to the sheets are stored in advance. The sheet information X100 is called paper catalogue or the like.

Figure 5:
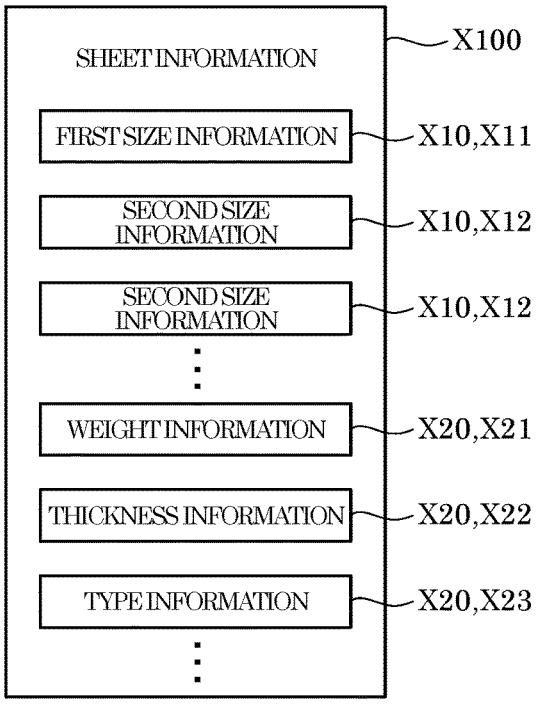
FIG. 5 is a diagram showing an example of sheet information stored in a storage portion of the image forming apparatus according to the embodiment of the present disclosure.

The sheet information X100 includes one or more pieces of first attribute information X10 (see FIG. 5). The first attribute information X10 is information related to a sheet size of a sheet. Each piece of the first attribute information X10 included in the sheet information X100 belongs to either first size information X11 (see FIG. 5) or second size information X12 (see FIG. 5). The first size information X11 is information corresponding to a sheet size detected by using the first detection portion 33 and the second detection portion 34. The second size information X12 is information corresponding to any of sheet sizes of sheets onto which an image can be formed in the image forming apparatus 100. It is noted that the sheet information X100 may be information that includes one piece of first size information X11 and does not include the second size information X12.

Further, the sheet information X100 includes a plurality of pieces of second attribute information X20 (see FIG. 5). The second attribute information X20 is information related to a sheet attribute of a sheet different from the sheet size. For example, the plurality of pieces of second attribute information X20 include weight information X21, thickness information X22, and type information X23. The weight information X21 is information corresponding to a sheet weight. The thickness information X22 is information corresponding to a sheet thickness. The type information X23 is information corresponding to a sheet type. In other words, the sheet attribute includes the sheet weight, thickness, and type. It is noted that the sheet attribute may also include a sheet color, material, and basis weight, whether or not the sheet is coated, a type of the coating material, and the like.

It is noted that according to a user operation on the operation display portion 4, the control portion 7 may additionally store, in the storage portion 8, the sheet information X100 having a content predetermined by a user. Also according to a user operation on the operation display portion 4, the control portion 7 may change a content of the existing sheet information X100 stored in the storage portion 8.

Alternatively, the plurality of pieces of sheet information X100 may be stored in a storage device of a server communicably connected with the image forming apparatus 100. In this case, the control portion 7 only needs to acquire the plurality of pieces of sheet information X100 from the server.

In the image forming apparatus 100, a processing condition of the stored sheets is set based on the sheet information X100 designated by the user out of the plurality of pieces of sheet information X100 stored in the storage portion 8. The processing condition includes a conveying condition of the stored sheets and an image forming condition of the image forming portion 5 with respect to the stored sheets. Specifically, the conveying condition is a conveying speed of the stored sheets. Further, the image forming condition is the fixing temperature.

It is noted that the conveying condition may be conveying intervals of the stored sheets. Moreover, the image forming condition may be a secondary transfer current supplied to the secondary transfer roller 27 or a contact pressure between the fixing roller 28A and the pressure roller 28B. Furthermore, the processing condition may be either one of the conveying condition and the image forming condition.

The setting of the processing condition is executed by the control portion 7. Hereinafter, the configuration of the control portion 7 will be described in detail with reference to FIG. 2.

[Configuration of Control Portion 7]

As shown in FIG. 2, the control portion 7 includes a detection processing portion 61, a first acceptance processing portion 62, a display processing portion 63, a setting processing portion 64, a second acceptance processing portion 65, and a change processing portion 66.

Specifically, a processing condition setting program for causing the CPU 51 to function as the respective portions described above is stored in advance in the ROM 52 of the control portion 7. Then, the CPU 51 executes the processing condition setting program stored in the ROM 52 to function as the detection processing portion 61, the first acceptance processing portion 62, the display processing portion 63, the setting processing portion 64, the second acceptance processing portion 65, and the change processing portion 66.

It is noted that the processing condition setting program may be recorded onto a computer-readable recording medium such as a CD, a DVD, and a flash memory and read from the recording medium to be stored in the storage portion 8. Moreover, some or all of the detection processing portion 61, the first acceptance processing portion 62, the display processing portion 63, the setting processing portion 64, the second acceptance processing portion 65, and the change processing portion 66 may be constituted by an electronic circuit such as an integrated circuit (ASIC).

The detection processing portion 61 detects a sheet size of the stored sheets.

For example, the detection processing portion 61 detects a sheet size of the stored sheets when an attachment of the sheet feed cassette 31 to the housing 1 is detected.

For example, the detection processing portion 61 determines the size of the stored sheets in the sheet conveying direction D5 based on the first electric signal output from the first detection portion 33. Moreover, the detection processing portion 61 detects the size of the stored sheets in the sheet width direction D6 based on the second electric signal output from the second detection portion 34. Then, the detection processing portion 61 determines the sheet size of the stored sheets based on the determination result on the size of the stored sheets in the sheet conveying direction D5 and the determination result on the size of the stored sheets in the sheet width direction D6.

The first acceptance processing portion 62 accepts a first designation operation for designating the sheet information X100.

Figure 6:
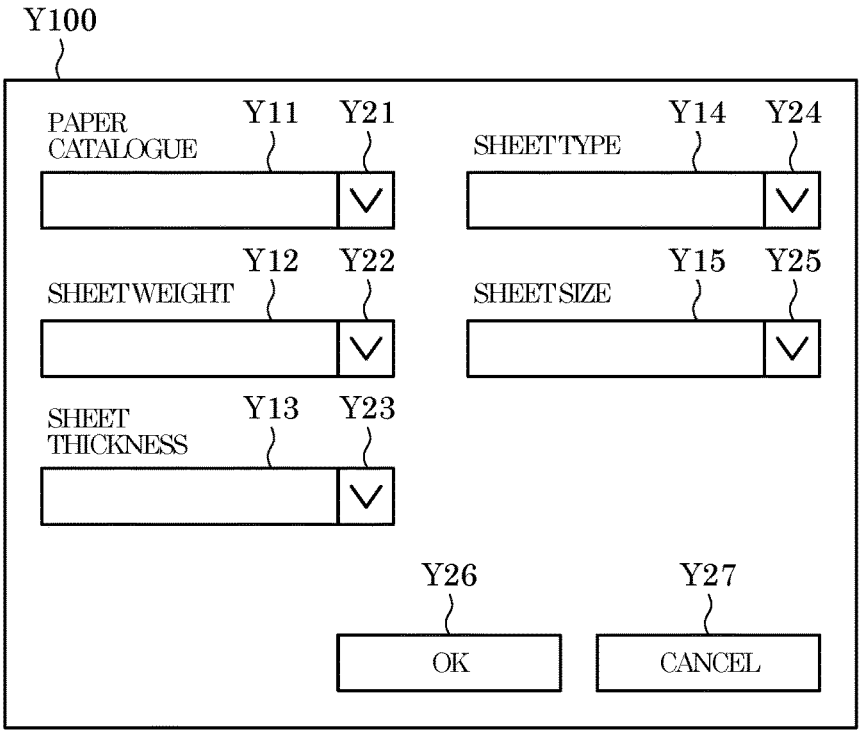
FIG. 6 is a diagram showing an example of a setting screen displayed in the image forming apparatus according to the embodiment of the present disclosure.

For example, the control portion 7 causes the operation display portion 4 to display a setting screen Y100 shown in FIG. 6 according to a predetermined operation made to the operation display portion 4.

As shown in FIG. 6, the setting screen Y100 includes a sheet information display field Y11, a weight display field Y12, a thickness display field Y13, a type display field Y14, and a size display field Y15. The setting screen Y100 also includes operation keys Y21 to Y27.

In the sheet information display field Y11, identification information (see FIG. 8) of the sheet information X100 designated by the user is displayed. The operation key Y21 is provided in correspondence with the sheet information display field Y11 and is operated when the user designates the sheet information X100.

In the weight display field Y12, information indicating a sheet weight (see FIG. 8) is displayed. The operation key Y22 is provided in correspondence with the weight display field Y12 and is operated when the user designates a sheet weight.

In the thickness display field Y13, information indicating a sheet thickness (see FIG. 8) is displayed. The operation key Y23 is provided in correspondence with the thickness display field Y13 and is operated when the user designates a sheet thickness.

In the type display field Y14, information indicating a sheet type (see FIG. 8) is displayed. The operation key Y24 is provided in correspondence with the type display field Y14 and is operated when the user designates a sheet type.

In the size display field Y15, information indicating a sheet size of a sheet (see FIG. 8) is displayed. The operation key Y25 is provided in correspondence with the size display field Y15 and is operated when the user designates a sheet size of a sheet.

Figure 7:
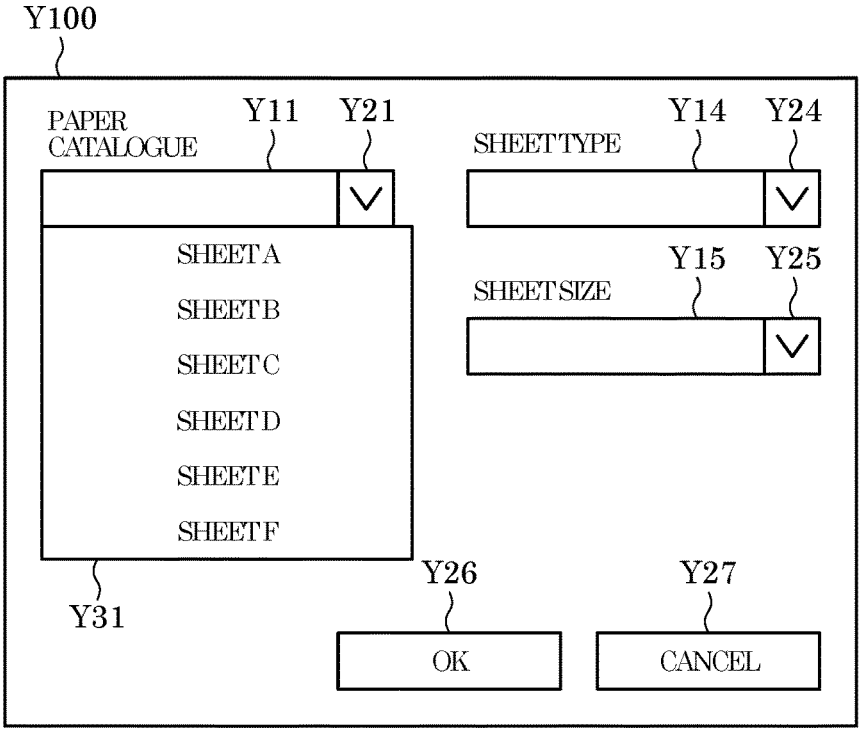
FIG. 7 is a diagram showing an example of the setting screen displayed in the image forming apparatus according to the embodiment of the present disclosure.

The first acceptance processing portion 62 causes a first designation candidate display field Y31 shown in FIG. 7 to be displayed according to an operation to the operation key Y21 included in the setting screen Y100. In the first designation candidate display field Y31, some or all of the plurality of pieces of sheet information X100 stored in the storage portion 8 are displayed in a selectable manner. It is noted that when causing some of the plurality of pieces of sheet information X100 stored in the storage portion 8 to be displayed in the first designation candidate display field Y31, the first acceptance processing portion 62 only needs to switch the sheet information X100 to be displayed in the first designation candidate display field Y31 according to a user operation made to the first designation candidate display field Y31. An operation of designating any of the sheet information X100 displayed in the first designation candidate display field Y31 is an example of the first designation operation.

When the first designation operation is accepted by the first acceptance processing portion 62, the display processing portion 63 updates the display content of the setting screen Y100 based on the sheet information X100 designated by the first designation operation.

Here, when the sheet information X100 designated by the first designation operation includes the first size information X11 (an example of specific attribute information of the present disclosure), the display processing portion 63 causes the setting screen Y100 including a detection result obtained by the detection processing portion 61 and the second attribute information X20 included in the sheet information X100 to be displayed.

Furthermore, when the sheet information X100 designated by the first designation operation does not include the first size information X11, the display processing portion 63 causes the setting screen Y100 including any of the second size information X12 and the second attribute information X20 included in the sheet information X100 to be displayed.

Figure 8:
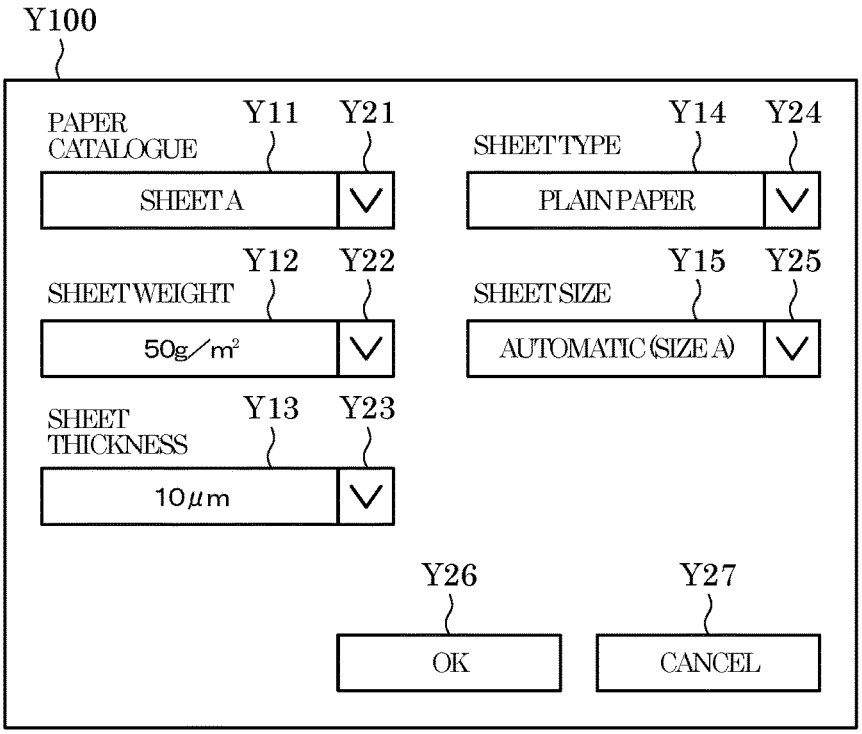
FIG. 8 is a diagram showing an example of the setting screen displayed in the image forming apparatus according to the embodiment of the present disclosure.

For example, the display processing portion 63 causes identification information of the sheet information X100 designated by the first designation operation to be displayed in the sheet information display field Y11 (see FIG. 8).

Moreover, the display processing portion 63 causes information indicating a sheet weight corresponding to the weight information X21 included in the sheet information X100 designated by the first designation operation to be displayed in the weight display field Y12 (see FIG. 8).

Further, the display processing portion 63 causes information indicating a sheet thickness corresponding to the thickness information X22 included in the sheet information X100 designated by the first designation operation to be displayed in the thickness display field Y13 (see FIG. 8).

Further, the display processing portion 63 causes information indicating a sheet type corresponding to the type information X23 included in the sheet information X100 designated by the first designation operation to be displayed in the type display field Y14 (see FIG. 8).

Moreover, when the sheet information X100 designated by the first designation operation includes the first size information X11, the display processing portion 63 causes information indicating a sheet size of a sheet corresponding to the detection result obtained by the detection processing portion 61 to be displayed in the size display field Y15 (see FIG. 8).

Furthermore, when the sheet information X100 designated by the first designation operation does not include the first size information X11, the display processing portion 63 causes information indicating a sheet size corresponding to any of the second size information X12 included in the sheet information X100 to be displayed in the size display field Y15.

The setting processing portion 64 sets the processing condition based on the information included in the setting screen Y100.

For example, when the operation key Y26 included in the setting screen Y100 is operated, the setting processing portion 64 sets the processing condition based on information related to the sheet, that is displayed in the setting screen Y100 at the time the operation is made.

It is noted that when the operation key Y27 included in the setting screen Y100 is operated, the control portion 7 ends the display of the setting screen Y100 without setting the processing condition.

Incidentally, in the image forming apparatus 100, the detection result obtained by the detection processing portion 61, that is included in the setting screen Y100, and the actual sheet size may not match. Herein, when the sheet size included in the setting screen Y100 is to be changed from the detection result obtained by the detection processing portion 61 and a sheet size to be changed into is to be selected from all of the sheet sizes used for setting the processing condition, the user needs to go to the trouble of looking for the sheet size to be changed into.

In contrast, in the image forming apparatus 100 according to the embodiment of the present disclosure, it is possible to save the trouble of the user that is caused when changing the sheet size used for setting the processing condition as described below.

The second acceptance processing portion 65 causes some of the sheet sizes used for setting the processing condition to be displayed according to a specific operation corresponding to the detection result obtained by the detection processing portion 61, that is included in the setting screen Y100, and accepts a second designation operation for designating any of the displayed sheet sizes.

Specifically, according to the specific operation, the second acceptance processing portion 65 causes one or more sheet sizes respectively corresponding to one or more pieces of second size information X12 included in the sheet information X100 designated by the first designation operation to be displayed.

Figure 9:
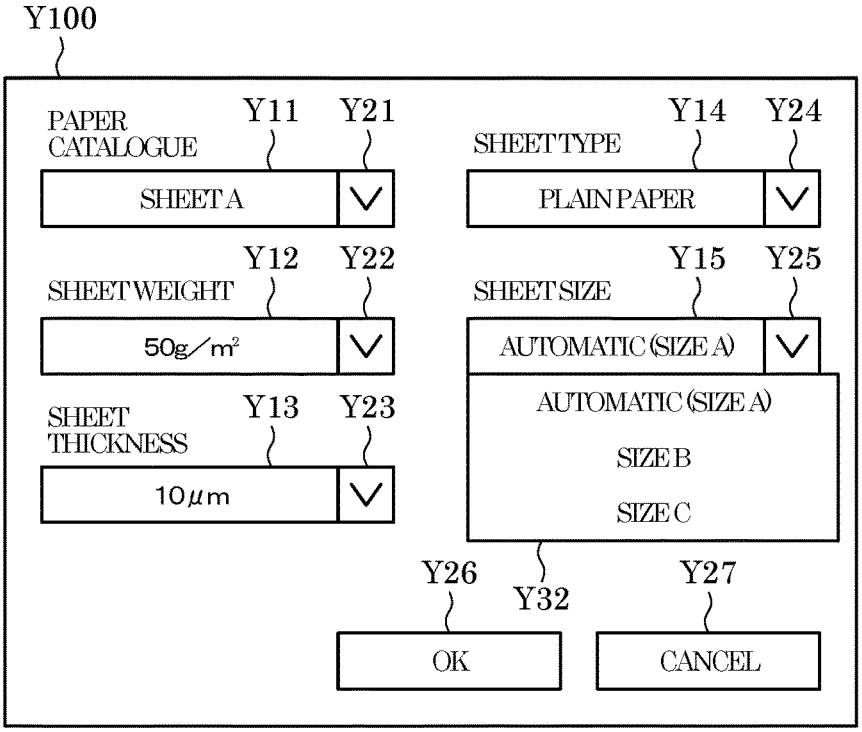
FIG. 9 is a diagram showing an example of the setting screen displayed in the image forming apparatus according to the embodiment of the present disclosure.

For example, when the detection result obtained by the detection processing portion 61 is displayed in the setting screen Y100, the second acceptance processing portion 65 causes a second designation candidate display field Y32 shown in FIG. 9 to be displayed according to an operation to the operation key Y25 (an example of the specific operation of the present disclosure). In the second designation candidate display field Y32, one or more sheet sizes respectively corresponding to the one or more pieces of second size information X12 included in the sheet information X100 designated by the first designation operation are displayed in a selectable manner. The detection result obtained by the detection processing portion 61 is also displayed in the second designation candidate display field Y32 in a selectable manner. An operation of selecting any of the sheet sizes displayed in the second designation candidate display field Y32 is an example of the second designation operation.

It is noted that the specific operation may be an operation made to a display area of the detection result obtained by the detection processing portion 61, that is included in the setting screen Y100.

According to the second designation operation, the change processing portion 66 changes the sheet size included in the setting screen Y100 from the detection result obtained by the detection processing portion 61 to the sheet size designated by the second designation operation.

For example, the change processing portion 66 causes information indicating the sheet size designated by the second designation operation to be displayed in the size display field Y15.

[Processing Condition Setting Processing]

Figure 10:
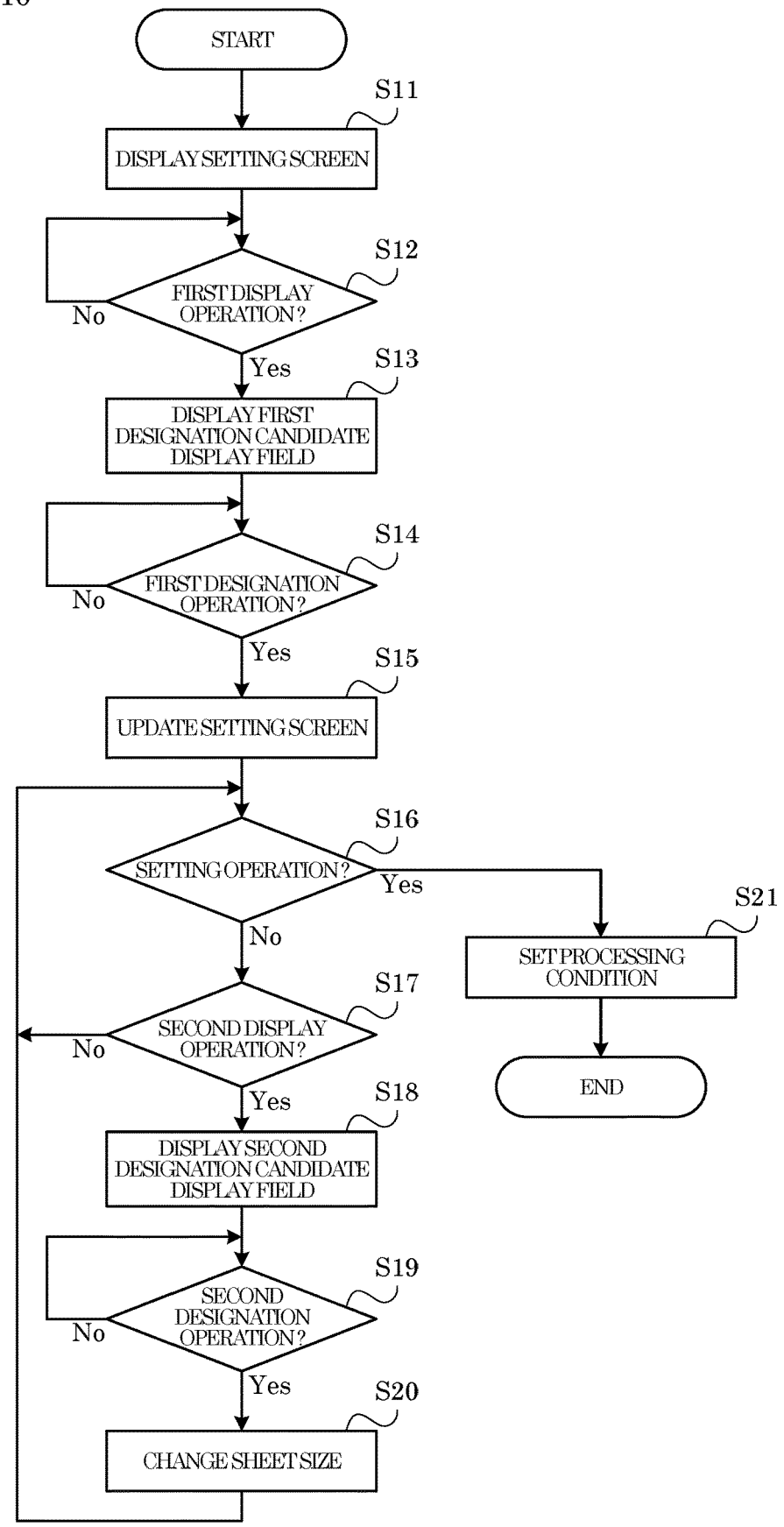
FIG. 10 is a flowchart showing an example of processing condition setting processing executed in the image forming apparatus according to the embodiment of the present disclosure.

Hereinafter, with reference to FIG. 10, a processing condition setting method of the present disclosure will be described along with exemplary procedures of the processing condition setting processing executed by the control portion 7 in the image forming apparatus 100. Herein, Steps S11, S12, . . . represent numbers of processing procedures (steps) executed by the control portion 7. It is noted that the processing condition setting processing is executed when an operation of inputting a display instruction of the setting screen Y100 is made on the operation display portion 4.

It is noted that the sheet size of the stored sheets is detected in advance before the processing condition setting processing. Specifically, the sheet size of the stored sheets is detected at the time of the last attachment of the sheet feed cassette 31. Herein, the processing of detecting the sheet size of the stored sheets is an example of a detection step of the present disclosure and is executed by the detection processing portion 61 of the control portion 7.

<Step S11>

First, in Step S11, the control portion 7 causes the setting screen Y100 in which all of the sheet information display field Y11, the weight display field Y12, the thickness display field Y13, the type display field Y14, and the size display field Y15 are blank to be displayed (see FIG. 6).

<Step S12>

In Step S12, the control portion 7 determines whether or not a first display operation for inputting a display instruction of the first designation candidate display field Y31 has been made on the operation display portion 4.

Specifically, the control portion 7 determines that the first display operation has been made when the operation key Y21 included in the setting screen Y100 is operated.

Herein, when determining that the first display operation has been made (Yes in S12), the control portion 7 shifts the processing to Step S13. Alternatively, when determining that the first display operation has not been made (No in S12), the control portion 7 stands by until the first display operation is made in Step S12.

<Step S13>

In Step S13, the control portion 7 causes the operation display portion 4 to display the first designation candidate display field Y31 (see FIG. 7).

<Step S14>

In Step S14, the control portion 7 determines whether or not the first designation operation has been made in the first designation candidate display field Y31. Herein, the processing of Step S13 and Step S14 is an example of a first acceptance step of the present disclosure and is executed by the first acceptance processing portion 62 of the control portion 7.

Herein, when determining that the first designation operation has been made (Yes in S14), the control portion 7 shifts the processing to Step S15. Alternatively, when determining that the first designation operation has not been made (No in S14), the control portion 7 stands by until the first designation operation is made in Step S14.

<Step S15>

In Step S15, the control portion 7 updates the display content of the setting screen Y100 based on the sheet information X100 designated by the first designation operation (see FIG. 8). Herein, the processing of Step S15 is an example of a display step of the present disclosure and is executed by the display processing portion 63 of the control portion 7.

Herein, when the sheet information X100 designated by the first designation operation includes the first size information X11, the control portion 7 causes the setting screen Y100 including the detection result obtained by the detection processing portion 61 and the second attribute information X20 included in the sheet information X100 to be displayed.

Alternatively, when the sheet information X100 designated by the first designation operation does not include the first size information X11, the control portion 7 causes the setting screen Y100 including any of the second size information X12 and the second attribute information X20 included in the sheet information X100 to be displayed.

<Step S16>

In Step S16, the control portion 7 determines whether or not a setting operation for inputting a setting instruction of the processing condition, that is based on the current display content of the setting screen Y100, has been made on the operation display portion 4.

Specifically, the control portion 7 determines that the setting operation has been made when the operation key Y26 included in the setting screen Y100 is operated.

Herein, when determining that the setting operation has been made (Yes in S16), the control portion 7 shifts the processing to Step S21. Alternatively, when determining that the setting operation has not ben made (No in S16), the control portion 7 shifts the processing to Step S17.

<Step S17>

In Step S17, the control portion 7 determines whether or not a second display operation for inputting a display instruction of the second designation candidate display field Y32 has been made on the operation display portion 4.

Specifically, the control portion 7 determines that the second display operation has been made when the operation key Y25 included in the setting screen Y100 is operated.

Herein, when determining that the second display operation has been made (Yes in S17), the control portion 7 shifts the processing to Step S18. Alternatively, when determining that the second display operation has not been made (No in S17), the control portion 7 shifts the processing to Step S16.

<Step S18>

In Step S18, the control portion 7 causes the operation display portion 4 to display the second designation candidate display field Y32 (see FIG. 9).

Herein, in the second designation candidate display field Y32, one or more sheet sizes respectively corresponding to one or more pieces of second size information X12 included in the sheet information X100 designated by the first designation operation are displayed in a selectable manner. The detection result obtained by the detection processing portion 61 is also displayed in the second designation candidate display field Y32 in a selectable manner.

<Step S19>

In Step S19, the control portion 7 determines whether or not the second designation operation has bee made in the second designation candidate display field Y32. Herein, the processing of Step S18 and Step S19 is an example of a second acceptance step of the present disclosure and is executed by the second acceptance processing portion 65 of the control portion 7.

Herein, when determining that the second designation operation has been made (Yes in S19), the control portion 7 shifts the processing to Step S20. Alternatively, when determining that the second designation operation has not been made (No in S19), the control portion 7 stands by until the second designation operation is made in Step S19.

<Step S20>

In Step S20, the control portion 7 changes the sheet size displayed in the setting screen Y100 to a sheet size designated by the second designation operation. Herein, the processing of Step S20 is an example of a change step of the present disclosure and is executed by the change processing portion 66 of the control portion 7.

<Step S21>

In Step S21, the control portion 7 sets the processing condition based on the current display content of the setting screen Y100. Herein, the processing of Step S21 is an example of a setting step of the present disclosure and is executed by the setting processing portion 64 of the control portion 7.

As described above, in the image forming apparatus 100, some of the sheet sizes used for setting the processing condition are displayed according to the specific operation corresponding to the detection result obtained by the detection processing portion 61, that is included in the setting screen Y100, and the second designation operation for designating any of the displayed sheet sizes is accepted. Thus, the trouble of looking for the sheet size to be changed into by the user is saved as compared to a configuration in which all of the sheet sizes used for setting the processing condition are displayed according to the specific operation. Accordingly, in the image forming apparatus 100, it is possible to save the trouble of the user that is caused when changing the sheet size used for setting the processing condition.

Further, in the image forming apparatus 100, when the sheet information X100 designated by the first designation operation includes the first size information X11 and one or more pieces of second size information X12, one or more sheet sizes respectively corresponding to the one or more pieces of second size information X12 included in the sheet information X100 are displayed according to the specific operation. Thus, by preparing the sheet information X100 of a desired content, the user can arbitrarily set the sheet size to be displayed in the second designation candidate display field Y32.

It is noted that the second acceptance processing portion 65 may also cause, according to the specific operation, a sheet size that is undetectable by the detection processing portion 61 to be displayed out of the sheet sizes used for setting the processing condition.

Moreover, the second acceptance processing portion 65 may also cause, according to the specific operation, a predetermined number of sheet sizes that have been selected in a descending order of the number of uses to be displayed out of the sheet sizes used for setting the processing condition.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet processing apparatus, comprising:

a sheet feed cassette which stores a sheet; and a processor functioning as a detection processing portion which detects a sheet size of a stored sheet stored in the sheet feed cassette, a first acceptance processing portion which accepts a first designation operation for designating sheet information including one or more pieces of first attribute information related to a sheet size and second attribute information related to a sheet attribute different from the sheet size, a display processing portion which causes a setting screen to be displayed when any of the one or more pieces of first attribute information included in the sheet information designated by the first designation operation is predetermined specific attribute information, the setting screen including a sheet size detected by the detection processing portion and the second attribute information included in the sheet information as information used for setting a processing condition of the stored sheet, a setting processing portion which sets the processing condition based on information included in the setting screen, a second acceptance processing portion which causes some of sheet sizes used for setting the processing condition to be displayed according to a specific operation corresponding to the sheet size detected by the detection processing portion, that is included in the setting screen, and accepts a second designation operation for designating any of the displayed sheet sizes, and a change processing portion which changes, according to the second designation operation, the sheet size included in the setting screen from the sheet size detected by the detection processing portion to a sheet size designated by the second designation operation, wherein the first acceptance processing portion causes respective pieces of identification information for a plurality of pieces of the sheet information registered in the sheet processing apparatus in advance to be displayed in a selectable manner and accepts the first designation operation for designating any of the pieces of identification information displayed, and the second acceptance processing portion causes only one or more sheet sizes and the sheet size detected by the detection processing portion out of the sheet sizes used for setting the processing condition to be displayed in a selectable manner according to the specific operation and accepts the second designation operation, the one or more sheet sizes respectively corresponding to one or more pieces of the first attribute information different from the specific attribute information included in the sheet information designated by the first designation operation.

2. The sheet processing apparatus according to claim 1, further comprising an image forming portion which forms an image on the stored sheet that is conveyed, wherein the processing condition includes either one or both of a conveying condition of the stored sheet and an image forming condition with respect to the stored sheet.

3. A processing condition setting method executed in a sheet processing apparatus including a sheet feed cassette which stores a sheet, comprising:

a detection step of detecting a sheet size of a stored sheet stored in the sheet feed cassette;

a first acceptance step of accepting a first designation operation for designating sheet information including one or more pieces of first attribute information related to a sheet size and second attribute information related to a sheet attribute different from the sheet size;

a display step of causing a setting screen to be displayed when any of the one or more pieces of first attribute information included in the sheet information designated by the first designation operation is predetermined specific attribute information, the setting screen including a sheet size detected in the detection step and the second attribute information included in the sheet information as information used for setting a processing condition of the stored sheet;

a setting step of setting the processing condition based on information included in the setting screen;

a second acceptance step of causing some of sheet sizes used for setting the processing condition to be displayed according to a specific operation corresponding to the sheet size detected in the detection step, that is included in the setting screen, and accepting a second designation operation for designating any of the displayed sheet sizes; and a change step of changing, according to the second designation operation, the sheet size included in the setting screen from the sheet size detected in the detection step to a sheet size designated by the second designation operation, wherein in the first acceptance step, respective pieces of identification information for a plurality of pieces of the sheet information registered in the sheet processing apparatus in advance are displayed in a selectable manner, and the first designation operation for designating any of the pieces of identification information displayed is accepted, and in the second acceptance step, only one or more sheet sizes and the sheet size detected in the detection step out of the sheet sizes used for setting the processing condition are displayed in a selectable manner according to the specific operation, and the second designation operation is accepted, the one or more sheet sizes respectively corresponding to one or more pieces of the first attribute information different from the specific attribute information included in the sheet information designated by the first designation operation.

* * * * *